United States Patent [19]

Mancusi, Jr.

[11] 3,968,961

[45] July 13, 1976

[54] MERRY-GO-ROUND

[76] Inventor: Joseph J. Mancusi, Jr., Altair, Inc., 50 Altair Ave., Plymouth, Conn. 06782

[22] Filed: Dec. 11, 1974

[21] Appl. No.: 531,694

[52] U.S. Cl. ..... 272/44; 272/48

[51] Int. Cl.[2] ..... A63G 1/34

[58] Field of Search ..... 272/44, 45, 31 R, 32, 272/43, 36, 39, 40, 42, 46, 48, 28 R, 28 S; 104/58, 61, 83, 84, 85

[56] References Cited

UNITED STATES PATENTS

| | | | |
|---|---|---|---|
| 661,435 | 11/1900 | Anderson | 272/48 |
| 2,698,178 | 12/1954 | Williams | 272/43 |
| 3,222,063 | 12/1965 | Bloom | 272/48 |

*Primary Examiner*—Richard C. Pinkham
*Assistant Examiner*—Arnold W. Kramer

[57] ABSTRACT

A compact and easily assembled merry-go-round consists of a turntable supported at its periphery upon spaced inverted casters mounted on a frame bearing, on its underside and in verticle alinement with said casters, leveling devices. The turntable is fixed at its center to a vertical driven shaft rotatably mounted on the frame and coupled to an electric motor. Simulated animals pivotally carried by the turntable nutate as the turntable rotates through a cam follower relationsip with a sinusoidal track fixed to the upper side of the frame. A conically shaped column supports a canopy assembly and may bear switches to permit the riders to turn off and on the electric motor. A control box is also provided off of the turntable. A tape player and speakers are also provided on the turntable or in the control box and the column.

1 Claim, 2 Drawing Figures

MERRY-GO-ROUND

Figure 1:
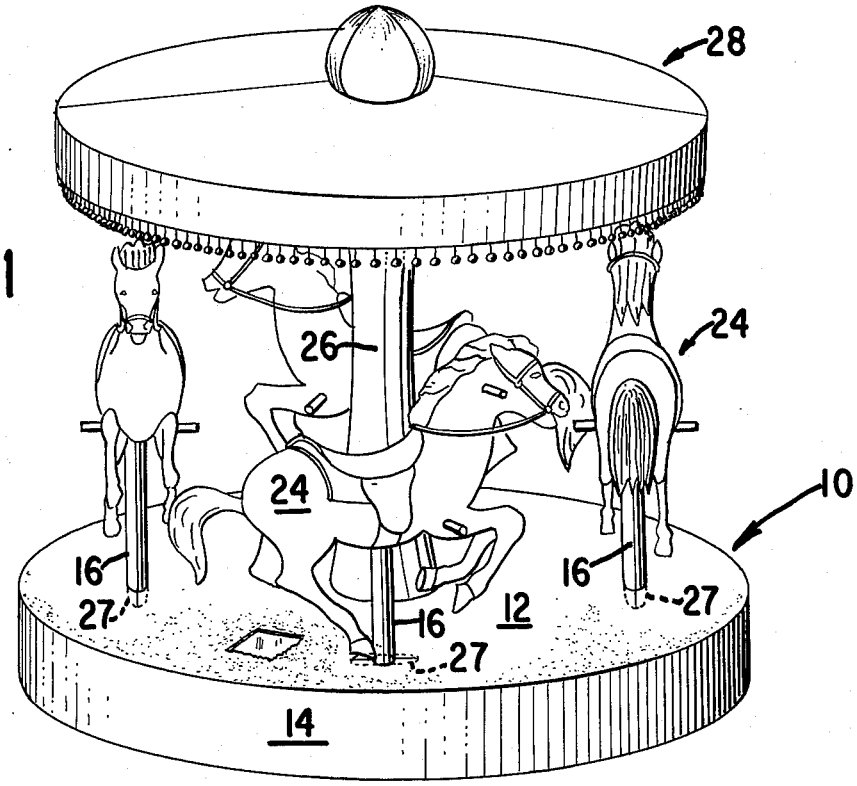

This invention relates to merry-go-rounds and more particlarly to a fully operational, compact and easily assembled merry-go-round intended for private home and nursery, day care center, motel and other use both indoor and out. Its construction will accommodate both young and old, of all sizes.

An object of this invention is to provide a merry-go-round suited to such utilization that is simple and inexpensive of construction and yet exceeds the action and atmosphere of a large scale public service machine.

Another object of the invention is to provide a merry-go-round that can be easily packed, shipped, unpacked and installed on site.

A further object of the invention is to provide a merry-go-round that is safe and reliable in operation and thus does not require the full time attendance and supervision of a mature and experienced adult.

Still another object of the invention is the provision of a merry-go-round that is attractive in appearance and economical of operation.

According to this invention, a square frame equipped with leveling devices serves as the main support for the merry-go-round. The frame centrally mounts a rotating vertical member to which a turntable, constituting the action platform of the merry-go-round is attached at its center. At the four corners and above the frame leveling points, the frame mounts upwardly disposed rollers which serve as points of support for the turntable on its underside, while accomodating its rotating motion about the center shaft. The turntable is circular in outline and generally flat, though it may be provided with a slight slope from the central point (where it is attached to the rotating vertical member) to its outer edge to facilitate draining off of water. At its periphery, the turntable is formed with a downwardly depending curtain to fence off the merry-go-round operating mechanism and safeguard the merry-go-round user from dangerous contact therewith.

The rotating motion of the turntable imparts the forward motion to the rideable animals, such as simulated horses, elephants, giraffs or others, of the merry-go-round. Beneath the turntable, cam-following mechanisms are attached in such a manner as to impart to rigidly affixed pipes rising vertically therefrom an up and down motion consistent with the cam form. These pipes extend above the surface of the turntable and have rigidily attached thereto the ridable animals. The cam-following member is fitted with a wheel at its trailing end, which serves to provide low friction contact with the cam. These cam-followers ride upon a track which is fixed to the square support frame. This track has high and low portions, and imparts an up and down and forward and backward tilting motion to the rideable animals as the turntable pulls the cam followers around. The weight of the horse causes the wheel on the cam follower to duplicate the rise and fall of the track and to provide and up and down and rocking motion to the rideable animals. Thus, a feature of the invention is that the loping or galloping action of a horse is realistically duplicated.

Rotating motion is imparted to the turntable through the output shaft (vertical rotating member) of a gear reducer mechanism (located at the turntable center and at right angles to the plane of the turntable) which is in turn driven by belts and pulleys coupled to an electrical motor. Electrical wires extend from the motor underneath the turntable via a guard or shield to the electrical power source. The merry-go-round is equipped also with a tape player and speakers for the playing of appropriate music for the carrousel activity. An alternate embodiment conducts the electrical wires leading from the motor through a guard to a central station. The central station connects to an appropriate electrical power supply and contains the electrical switches, along with a tape player and speakers.

A tubular central post on the turntable extends to a point above the animals to where it mounts a canopy. The canopy extends outwardly to cover essentially all of the platform and protect the users against the sun and rain.

Figure 2:
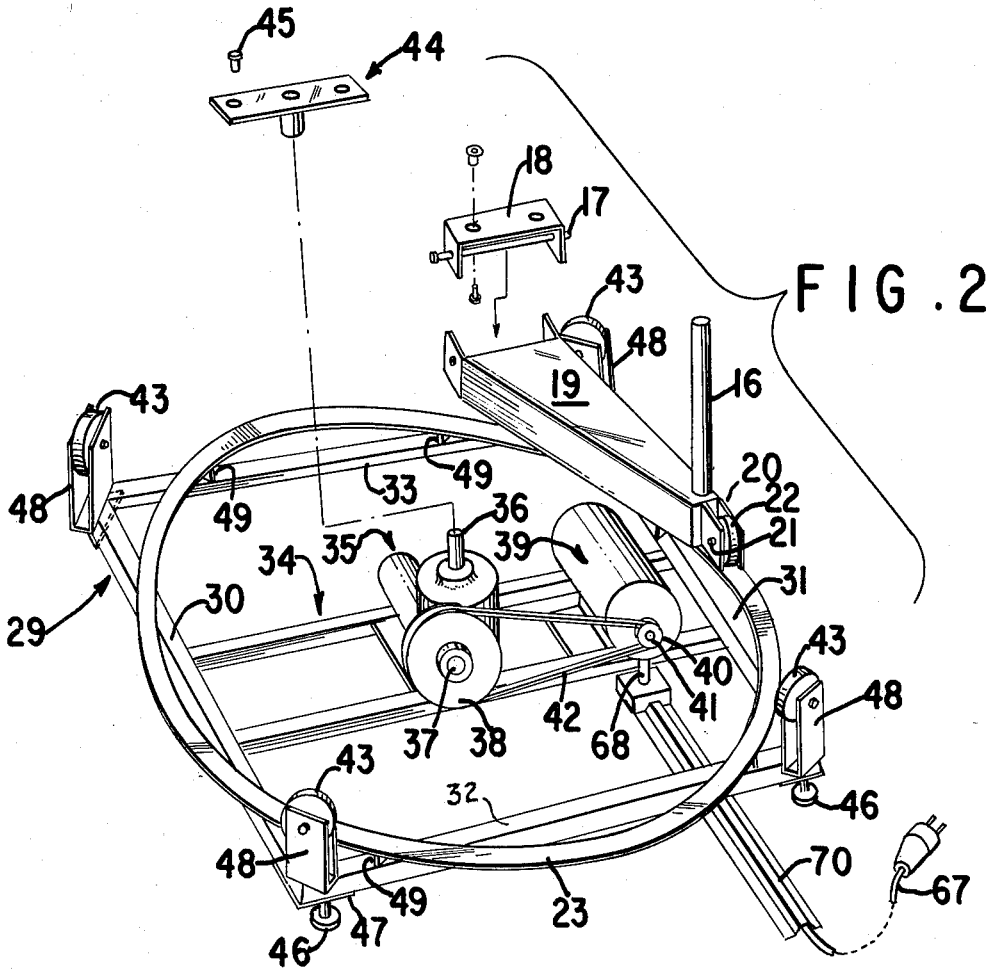

These and other objects, features, and advantages of the invention will become apparent from the reading of the following description of a preferred embodiment of the invention when considered with the accompanying drawing wherein:

FIG.1 is a perspective of a merry-go-round constructed according to the principles of the invention; and FIG. 2. is an exploded perspective of the support drive and action mechanism of the merry-go-round constructed according to the principles of the invention.

Turning now more particularly to FIG. 1., the merry-go-round is shown as including a turntable 10. The turntable includes a generally flat portion 12 extending outwardly from its central point to the circular periphery. At its periphery a downwardly depending curtain 14 isolates the mechanism underneath the turntable from the curiosity of children. The generally flat portion of the turntable mounts somewht inward from its periphery but equally distant from its center, four equally spaced vertical pipes 16. These pipes may be mounted by any conventional means as being welded to a cam-following mechanism beneath the flat portion of the turntable 12.

A typical cam-following mechanism (there are four) is fitted with a hinge pin 17 (FIG. 2) which co-acts with a bracket 18 which is securely fastened to the underside of the turntable 10. The cam follower structure 19 is fitted also with a bracket 20 and wheel pin 21 and wheel 22. The axis of the hinge pin 17 is so aligned as to permit the cam-following mechanism to impart to the pipe 16 the lifting and rocking motion induced by the cam form 23.

Atop the pipe 16 is fitted a suitable bracket for attachment of the rideable animals to it. The hinge restraint of the cam follower 19 and the fixed attachment of the pipe 16 maintain the animal facing in the direction of rotation.

The upward rise of the cam follower is so controlled as to maintain a clearance between it and the underside of the turntable 10 which would insure against hurting probing fingers of riders. Furthermore, the clearance between the pipe 16 and the aperture 27 in the turntable 10 is substantially reduced by the fit of a carpet which forms the upper surface of the turntable 12. The up and down and tilting motion of the pipe with respect to the carpet and turntable is the only relative motion of exposed members of the merry-go-round.

The central frame portion of the turntable 12 fixedly mounts an enlarged, somewhat conically shaped column 26. The upper end supports and is fixed to a canopy assembly 28. The canopy assembly 28 extends over the turntable 12 and protects the rider as well as the mechanism from sun and rain. The canopy assembly may be attractively decorated as shown. The column 26 and canopy assembly 28 join the animals 24 in rotating with the turntable 10.

The turntable 10 and associated structures described above are supported by a generally square-shaped rigid frame assembly indicated by the number 29 in FIG. 2. This generally square-shaped rigid frame assembly 29 includes L-shaped angle irons 30, 31, 32, and 33. Approximately midway, between L-shaped angle irons 30 and 31, the cross bar assembly 34 mounts the gear reducer 35 so that its vertically disposed shaft 36 becomes the rotating center of the turntable 10. The gear reducer 35 is fitted with a secondary shaft 37 to which is attached a pulley 38. An electric motor 39 is also fixed to the cross bar assembly 34 in such a manner that a smaller pulley 40 mounted to the motor shaft 41 can co-act in plane through a belt 42 with the gear reducer pulley 38. Thus, the rotational output of the motor 39 is transmitted to the gear reducer secondary shaft 37 and thence through its inner mechanism to the vertically disposed turntable driving shaft 36.

The turntable is vertically supported by the generally square-shaped rigid frame assembly 29 through inverted casters 43 which are fixed to the corners of the generally square-shaped rigid frame assembly 29. The turntable rests on the casters due to the action of gravity. Now, when electrical power is applied, the motor 39 through its pulley 40 drives the belt 42 and the larger pulley 38 of the gear reducer 35, thus producing motion of the vertically disposed gear reducer shaft 36 and the turntable 10 through the attachment means 44 and bolts 45.

The best turntable operation is somewhat dependent upon a flat orientation thereof. Accordingly, conventional screw leveling devices 46, located at the four corners of the generally square-shaped rigid frame assembly 29 are attached through suitable gussets 47 welded to the underside of the generally square-shaped rigid frame assembly corners. In this way a lighter frame assembly is possible, as the turntable weight is transmitted directly to the inverted casters 43, the brackets 48, the corners of the frame assembly 29, the gussets 47, to the leveling devices 46 and thence to the point of reaction against the surface beneath.

Also supported on the generally square-shaped rigid frame assembly 29 is a track 23 having three equally spaced sinsoidally shaped cam sections. The track 23 lies in a circular path about the gear reducer shaft 36 and is concentric with it. Where the track 23 crosses the angle irons 30, 31, 32, 33, suitable supports 49 are provided as necessary to allow for rigid attachment of the track 23 to the L-shaped angle irons 30, 31, 32, 33, through welding. Thus, the track 23 is firmly supported and becomes a part of the generally square-shaped rigid frame assembly 29.

The track 23 supports the wheel 22 of the cam followers 19 to which the rideable animals 24 are attached. The weight of the animals 24 causes the wheels 22 of the cam followers 19 to maintain contact with the track 23 and be vertically influenced by its sinsoidal contour as the turntable 10 pulls them around its center of rotation.

Operation of the merry-go-round will be effected upon plugging an electrical connector 67 extending from the motor 39 via a vertical conduit 68 and shield 70, into a suitable source of electrical power.

Operation of the merry-go-round may also be effected through a conviently located central station. Such a control station may include a tape record player, tapes, speakers, wiring, including an electrical connection line to a source of power, and switches. Access to the switches, record player, and tapes, would be effected by lifting the waterproof cover from the control station.

A second possiblity is to connect the electrical connector to an electrical outlet box equipped with a switch that is key-locked. Further, the speakers for a tape player could be mounted beneath the turntable, the tape player in a bench or basket surrounding the central column 26. Switches could be provided to the central column to permit the riders to turn the merry-go-round and the music on and off.

It will be apparent that rotation of the turntable moves the animals 24 in a forward direction, too. Up and down and tilting motion is imparted to the horses thru the following action of the wheels 22 upon the track cam 23.

While there has been shown and described a preferred embodiment of the invention, it will be understood that it was exemplary only and that the scope of the invention is intended to be limited only by the appended claims.

What is claimed is:

1. A compact and easily assembled merry-go-round comprising a turntable having a generally flat portion terminating in a depending curtain about its periphery, a column mounted on said turntable about its central portion, a canopy mounted on said column for rotation therewith and extending over said turntable, imitation animals carried by said turntable in its direction of rotation but movably disposed for up and down and forward and backward tilting motion by being mounted at the upper ends of straight elements extending from above to below the turntable through apertures therein and rigidly fixed to cam follower elements pivotally connected to the underside of the turntable, a carpet on the upper surface of the generally flat portion of said turntable and closely fitted to said straight elements to close off the space between each straight element and the edge of its aperture, a rigid frame underneath said turntable and inside its depending curtain, a circular track lying underneath said cam follower elements and fixed upon said frame, said circular track having vertical undulations, a turntable driving assembly including an electric motor mounted on said frame and establishing a driving connection with the central portion of the turntable, spaced frictionless rollers mounted on said frame and engaging the underside of the turntable for rotatable support thereof, and adjustable frame leveling devices located on said frame underneath said rollers in vertically aligned relationship therewith.

* * * * *